United States Patent [19]

Ohkubo et al.

[11] Patent Number: 4,498,755

[45] Date of Patent: Feb. 12, 1985

[54] DEVELOPING DEVICE FOR USE IN ELECTROPHOTOGRAPHY

[75] Inventors: Masaharu Ohkubo; Nobuhiro Hayashi; Tomohiro Aoki, all of Yokohama, Japan

[73] Assignee: Canon Kabushiki Kaisha, Tokyo, Japan

[21] Appl. No.: 309,382

[22] Filed: Oct. 7, 1981

[30] Foreign Application Priority Data

Oct. 16, 1980 [JP] Japan ..... 55-144788

[51] Int. Cl.[3] ..... G03G 15/09

[52] U.S. Cl. ..... 355/3 DD; 118/658

[58] Field of Search ..... 355/3 DD, 3 R; 118/653, 118/656, 657, 658

[56] References Cited

U.S. PATENT DOCUMENTS 4,177,757 12/1979 Murakawa et al. ..... 118/658

*Primary Examiner*—R. L. Moses

*Attorney, Agent, or Firm*—Fitzpatrick, Cella, Harper & Scinto

[57] ABSTRACT

A developing device for developing an electrostatic latent image formed by the electrophotographic process, etc., in which, when a developer on a non-magnetic sleeve used for developing an image is separated from the surface of this sleeve, the developer is divided into two streams, one of which is directly fed to a developer conveying device to convey the developer to a developing section for the image development, and the other of which is led to an agitating device to agitate the developer in the axial direction of the sleeve, and, after sufficient agitation, the developer stream is applied to the developer conveying device.

By the abovementioned construction, the developer from at least one of the abovementioned streams is supplied to the developer conveying device without failure, whereby a required quantity of the developer can always be supplied even when the developing device is driven at a high operating speed.

5 Claims, 4 Drawing Figures

DEVELOPING DEVICE FOR USE IN ELECTROPHOTOGRAPHY

BACKGROUND OF THE INVENTION

1. Field of the Invention

This invention relates to a developing device. More particularly, it is concerned with a dry-type developing device using a two component developer consisting of toner and carrier for developing an electrostatic latent image formed by the electrophotographic process, etc.

2. Description of Prior Art

For high speed development and low potential development of an electrostatic latent image having a low dark potential, a developing device using a two component developer consisting of carrier and toner is suitable. In such developing device, since the developer is conveyed at a high speed, it is necessary that the developer be uniformly distributed in the developing device, and that the developer be sufficiently agitated to render a mixing ratio between the carrier and the toner in the developer to be constantly uniform. In particular, the developing device using an automatic toner replenisher (ATR) of a volume detection type for maintaining constant the mixing ratio between the carrier and the toner requires sufficient agitation for the uniform mixture.

FIG. 1 of the accompanying drawing shows, in cross-section, one embodiment of the developing device suitable for such high speed, low potential development. This developing device is provided with a conveying sleeve 1 to take up the developer, and developing sleeves 2A, 2B to effect the development. These sleeves 1, 2A, and 2B rotate in their respective arrowed directions, a, b and c, and have within their interior fixed magnet rollers 3, 4A and 4B, respectively.

Agitation of the developer in the axial direction of the sleeves is effected by a pair of screw means 5A, 5B with their conveying directions mutually opposed. The toner from a hopper and the toner recovered by a cleaner are supplied into the screw means through a front side as viewed from the top surface of the drawing. In the drawing, the screw means 5A is for toner forwarding, and the screw means 5B is for toner returning. These screw means 5A, 5B are positioned in a developer sump 7 at the downstream region of a developer recovering path 6. They function to agitate the developer within the toner sump 7 and simultaneously cause the developer to circulate in the axial direction of the screw. A doctor blade 8 in the developer sump 7 regulates a quantity of the developer adhered on the sleeve 1. The developer as adhered on the conveying sleeve 1 is sequentially transferred to the developing sleeves 2A and 2B to develop the latent image on a latent image holding member 9. The developer, which has passed through developing positions n and s for development of the latent image, leaves the sleeve 2B on its own dead weight and falls into the developer sump 7.

Even in high speed development using the developing device of the above-described construction, if its speed is relatively slow, the uniform distribution of the developer and the uniform mixing ratio between the carrier and the toner in the developer within the developing device are well maintained. However, when the speed becomes very high, a balance is lost between a quantity of the developer which the sleeves convey and a quantity of the developer which the screws means convey. On account of this, the developer in the developer sump 7 cannot be uniformly distributed on the conveying sleeve, whereby erection of ears of the developer becomes non-uniform, and, even if the developer becomes uniformly distributed temporarily, its maintenance and stabilization are very difficult. This is considered to be due to the developer of low toner concentration, which has fallen from the sleeve 2B after the development, being directly attracted to the conveying sleeve before it is sufficiently agitated in the developer sump.

FIG. 2 of the accompanying drawing shows, in cross-section, another embodiment of the developing device as disclosed in U.S. Pat. No. 4,177,757. In the drawing, those parts having the same functions as those of the developing device shown in FIG. 1 are designated by the same reference symbols.

In this developing device, the developer on the sleeve 2B is scraped off at the forward edge of a partitioning plate 10 to cause substantially the entire part of the developer on the sleeve 2B to fall into the developer sump 7, and to return the same to the sleeve 1 after the developer is conveyed in the axial direction of the sleeves by the screw means 5B along with its agitation.

On the other hand, a small quantity of the developer falling from the sleeve 2B is led to a developer storage chamber 11. This developer storage chamber 11 temporarily stores therein the developer which will be circulated in the developing device. By keeping off the developer, for a while, from its high speed moving to recuperate its function, it is possible to gradually replenish the recuperated developer through an opening 15 into the circulation path, whereby the life of the developer in the developing device as a whole can be prolonged. By rotation of blades 12, 14 at a very slow speed through a feeder shaft 13, the developer is pushed out into the developer sump 7 bit by bit through the opening 15 of the storage chamber 11. Then, the replenishing developer is fed into the storage chamber 11 from the forward end of the buffer plate 10 for an amount pushed out of the opening 15.

In the above-described developing device, as compared with the device shown in FIG. 1, the life of the developer becomes prolonged because it is temporarily stored in the developer storage chamber 11 for recuperation from its fatigue caused by its repeated use. On the other hand, however, the sleeve 1 continues to attract and convey the developer from the developer sump 7, on account of which the problem as stated in reference to the device shown in FIG. 1 remains unsolved.

SUMMARY OF THE INVENTION

It is therefore an object of the present invention to provide a developer device capable of realizing stable ear erection of the developer and maintaining a uniform mixing ratio between the carrier and the toner of the developer along the axial direction of the sleeve.

It is another object of the present invention to provide a developing device capable of satisfactorily attaining the abovementioned purpose even in case of high speed operation.

It is still another object of the present invention to provide a developing device durable against high speed development operation by feeding the minimum required amount of the developer to the developing device, even when it is operated at a high speed.

With a view to attaining the purpose of the present invention as mentioned in the foregoing, the developing device is so constructed that the developer is divided into two streams when it is separated from the surface of the non-magnetic developing sleeve, after it has served for the development. One of the two streams of the developer is directly supplied to the conveying means, while the other stream of the developer is led to means for agitating it in the axial direction of the sleeve where the developer is not only agitated for uniform mixture of the carrier and the toner, but also rendered uniform in its quantity along the direction of the rotational axis of the sleeve, thereby feeding the developer to the conveying means for conveying it to the developing section. The one stream of the developer as divided by the abovementioned construction is sufficiently agitated after it has been separated from the sleeve surface until it reaches a position where it is supplied to the abovementioned developer conveying means. Further, since this one stream of the developer is conveyed in a substantially constant quantity, the minimum amount of the developer is forwarded to the sleeve without failure, hence there is no problem at all even if the developing sleeve is rotated at a high speed.

DETAILED DESCRIPTION OF THE PREFERRED EMBODIMENTS

In the following, the present invention will be explained in detail with reference to preferred embodiments thereof as shown in the accompanying drawing.

Figure 1:
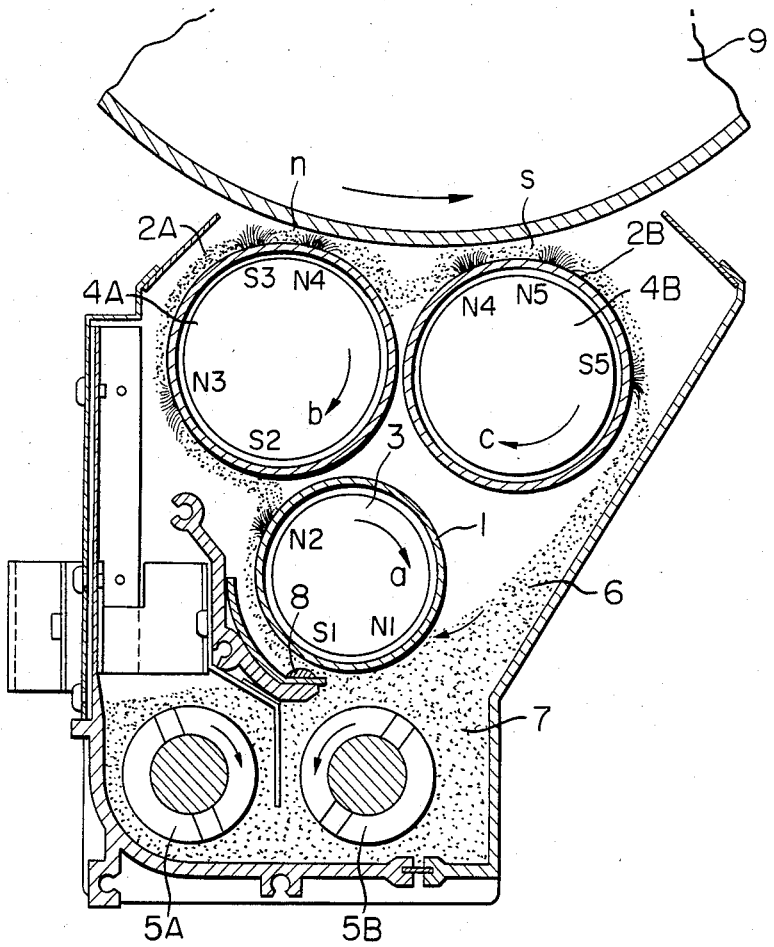
FIG. 1 PRIOR ART
FIG. 1 and FIG. 2 are cross-sectional views of the conventional developing device.
Figure 2:
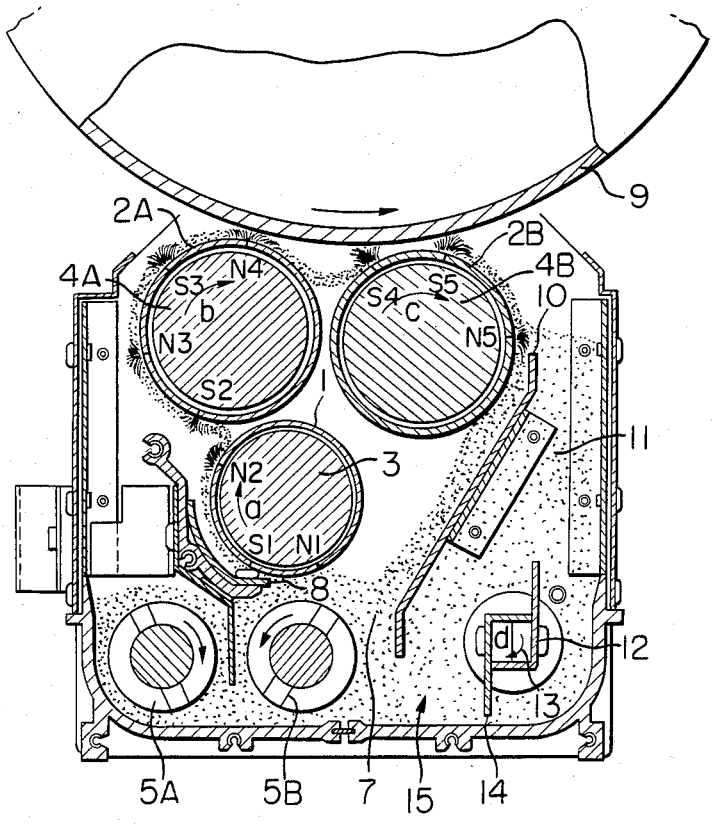
FIG. 2 PRIOR ART
Figure 3:
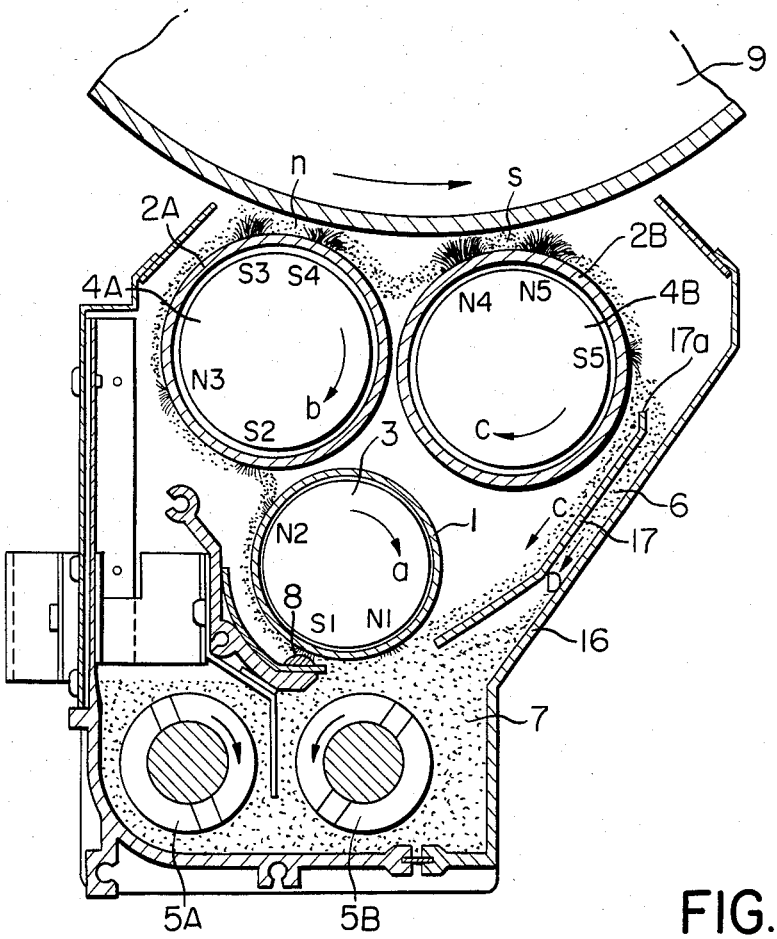
FIG. 3 and FIG. 4 are cross-sectional views of preferred embodiments of the developing device according to the present invention.

FIG. 3 is a cross-sectional view of one embodiment of the developing device, to which the concept of the present invention is applied. In the drawing, those elements having the same functions and operations as those shown in FIG. 1 are designated by the same reference numerals and symbols.

At a developing position n in the magnet roller 4A, there are disposed two different magnetic poles $S_3$ and $S_4$, and the image development is done with good edging effect by a magnetic brush to be formed with the magnetic poles as the center.

Also, at a developing position s in the magnet roller 4B, there are disposed two magnetic poles $N_4$ and $N_5$ of the same polarity. By utilization of replusive magnetic fields by both magnetic poles $N_4$ and $N_5$, there is effected powder-clouding and cascading development between the two magnetic poles whereby a solid black image can be effectively reproduced. The developer which has finished development of the latent image on the latent image holding member 9 is separated from the surface of the developing sleeve 2B, and falls in the direction of the developer recovery path 6 disposed along the side wall 16 of the developing device. The developer recovery path 6 is defined by a flow dividing plate 17 made of a non-magnetic material in the manner as shown in the drawing. The flow dividing plate 17 extends in the axial direction of the sleeves, and the top portion 17*a* of the flow dividing plate 17 also functions to scrape the developer off the sleeve 2B. The developer thus scraped-off, or naturally fallen, is divided by the flow dividing plate 17 into a developer flow D which falls into the developer recovery path 6 along the side wall 16 of the developing device and a developer flow c which falls along the surface of the flow dividing plate 17. The developer of the flow c which has fallen along the flow dividing plate 17 is agitated, while it is rolling down on and along the flow dividing plate, and once accumulates at the lower part of the flow divding plate 17, after which it is promptly attracted onto the surface of the conveying sleeve 1, and transported to the developing sleeves 2A and 2B. On the other hand, the developer of the flow D which has fallen along the developer recovery path 6 is also agitated in the same manner, while it is rolling down, and accumulates on the top part of the developer sump 7. This latter developer is not directly attracted to the conveying sleeve 1 due to presence of the lower part of the flow dividing plate 17, but it is conveyed in the axial direction of the sleeves, during which the toner and the carrier thereof are agitated by the screw means 5B for uniform mixing. After this, a part of the developer is attracted to the conveying sleeve 1, while the remaining part is continuously conveyed in the axial direction of the sleeve by the screw means 5B.

According to the developing device of the above-described construction of the present invention, a certain constant quantity of the well agitated developer is always fed to the taking-up and conveying sleeve 1 to transport the developer to the developing sleeves, and, since the feeding quantity of the developer corresponds to the number of revolution of the sleeve or its peripheral speed, the developer can be conveyed to the developing sleeves 2A and 2B without failure, even when the developing device operates at a high speed. At the same time, a certain definite quantity of the developer is constantly and forcibly supplied to the agitating section in the developer sump 7, which enables the developer with the carrier and the toner therein having been sufficiently agitated and mixed to be fed to the taking-up and conveying sleeve 1. Accordingly, the well agitated developer is constantly supplied onto the surface of the sleeve 1, whereby stable development of a latent image becomes possible.

In the foregoing explanations of the present invention, use of a single sleeve 1 has been described as an example, although the present invention is also applicable to a construction, wherein the developer is conveyed to the developing sleeve 2A through a plurality of taking-up and conveying sleeves.

EXPERIMENTAL EMBODIMENT

Using the conventional developing device as shown in FIG. 1, the latent image development was conducted at a process speed, i.e., rotational speed of the latent image holding member 9, of 430 mm/sec. and at a peripheral speed of the sleeves 1, 2A and 2B of 500 mm/sec. There occurred no non-uniformity in application of the developer onto the sleeve surface, nor non-uniformity in mixing of the toner and the carrier. However, when the development was conducted at an increased process speed of 730 mm/sec., and an increased peripheral speed of the sleeves of 850 mm/sec., most of the developer that fell off the developing sleeve 2B was attracted directly to the conveying sleeve 1 before it was agitated by the returning screw means 5B, and the developer could not be sufficiently agitated owing to continuation of such state. Further, due to change in durability of the developer, the surface state of the carrier changes, and the developer changes its adhesivity to the sleeve surface with the consequence that the falling position of the developer off the sleeve also changes. On account of this, a balance is lost between the quantity of the developer to be attracted to, and conveyed by, the conveying sleeve 1 and the quantity of the developer to be conveyed by the screw means with the result that only a small amount of developer is transported by the screw means in the axial direction of the sleeve, hence the quantity of the developer in the developer sump is also non-uniform.

In contrast, when the development was conducted at the abovementioned higher process speed and peripheral speed of the sleeve, using the developing device shown in FIG. 3, it was found that most of the developer in the flow D was prevented from being directly attracted to the conveying sleeve 1 owing to its flow beneath the flow dividing plate, and, after it had once been agitated by the screw means 5B, a part of the developer was attracted to the sleeve 1. On account of this, most of the developer flow D was conveyed in the axial direction of the sleeve by the screw means, while it was being agitated. Therefore, the developer is present in the axial direction of the sleeve in a state of its being agitated sufficiently.

As the consequence of this, the degree of agitation of the developer improves, and, in addition, since only a required quantity of the developer which has finished the development is agitated, it makes it unnecessary to rotate the screw means at a higher speed than required, or enlarge the outer diameter of the screw means, but the peripheral speed of the screw means can be slowed down, which is effective for preventing the developer from deterioration. Furthermore, a certain definite quantity of the developer is supplied in accordance with the flow C, temporarily stays in a space between the flow dividing plate 17 and the side wall 16 of the developing device for necessary agitation, and is subsequently fed to the conveying sleeve 1 for a certain definite quantity by the screw means 5B. On account of this, a certain definite quantity of the developer can be attracted onto the conveying sleeve 1. However, the quantity of the developer on the developing sleeve 1 becomes constant, and the ear erection of the developer can be made uniform. At the same time, the quantity of the developer in the developer sump can also be made uniform, whereby the present invention is proved to be particularly effective when using the automatic toner replenisher (ATR) of the volume detecting type. Incidentally, in the above-described embodiment, the flow rate of the developer in the flow C and the flow D are substantially the same.

Figure 4:
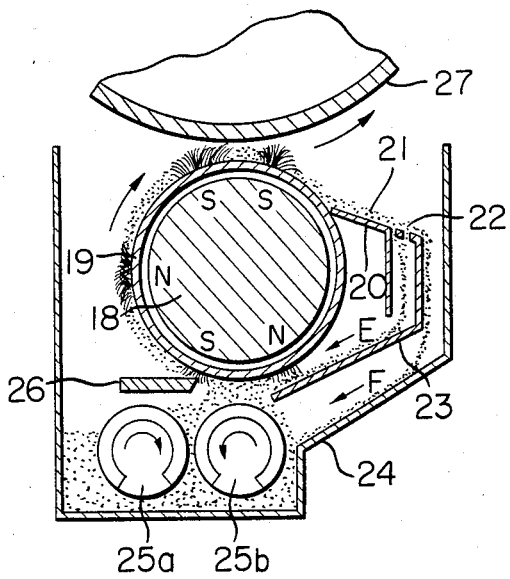

FIG. 4 shows another embodiment of the developing device according to the present invention, wherein the scraper 20 is contiguous to the surface of the sleeve 19 with a fixed magnet 18 set in its interior and rotating in an arrowed direction, thereby scraping the developer off the sleeve 19. The developer 21 as scraped off is divided into two flows E and F through an opening 22 formed at a position downstream of the scraper 20. The developer flow E is led on and along the flow dividing plate 23 and, after its agitation during its falling from the sleeve 19, is immediately attracted back to the sleeve 19 due to the magnetic poles provided in its interior. Another developer flow F is also agitated during its falling in the same manner as above, after which it is guided along the outer wall 24 of the developing device, and conveyed in the axial direction of the sleeve by the agitating and conveying screw means 25A and 25B, while it is being agitated simultaneously. Thereafter, the developer is attracted to the sleeve 19 along with the developer of the flow E, is regulated its quantity and thickness on the sleeve by the doctor blade to thereby determine a quantity of the developer suitable for the development, and serves for developing a latent image on the latent image holding member 27 at the developing position.

As is the case with the developing device in FIG. 3, the developing device according to this embodiment makes it possible to apply the minimum amount of the developer onto the sleeve 19 and to forcibly agitate a part of the developer by compulsorily dividing the flow of the developer to be conveyed to the sleeve 19 and the screw 25, whereby the developing device can be driven at a high speed. Incidentally, the term "high speed" for use in driving the developing device according to the present invention designates approximately 500 mm/sec. as the rotational peripheral speed for the developing sleeve.

We claim:

1. A developing device for developing a latent image on an image holding member, comprising:

(a) magnetic field generating means having magnetic poles;

(b) non-magnetic sleeve means disposed around said magnetic field generating means for conveying developer on the surface thereof upto a developing position; and (c) means for dividing developer which has left the surface of said sleeve means, after development, into two streams, said dividing means being positioned at the downstream side of a developing position in the moving direction of said developer on said sleeve means, and leading the first developer stream directly to said sleeve means, and leading the developer in the second stream to the side of agitating means for the developer, said sleeve means carrying the developer of said first developer stream and the developer at the position of the agitating means, thereby developing the latent image on said image holding member.

2. The developing device as set forth in claim 1, wherein said magnetic field generating means is fixed, and said sleeve means rotates around said magnetic field generating means.

3. A developing device for developing a latent image on an image holding member, comprising:

(a) magnetic field generating means having magnetic poles;

(b) non-magnetic sleeve means disposed around said magnetic field generating means for conveying developer on the surface thereof upto a developing position;

(c) means for applying the developer to said sleeve means;

(d) screw means for conveying the developer in the axial direction of said sleeve means; and (e) means for dividing the developer removed from the surface of said sleeve means, after development, into two developer flows of substantially the same flow rate, said developer dividing means being positioned so as to lead one developer flow directly onto said developer applying means and the other developer flow onto said screw means.

4. The developing device as set forth in claim 3, wherein said magnetic field generating means is fixed, and said sleeve means rotates around said magnetic field generating means.

5. A developing device according to claim 3, wherein said developer dividing means (17) is placed near said sleeve (2B) in such a manner that the leading edge (17*a*) of said developer dividing means scrapes the developer disposed on said sleeve (2B) to form two developer flows of substantially the same flow rate.

* * * * *